US005332643A

United States Patent [19]

Harada et al.

[11] Patent Number: 5,332,643

[45] Date of Patent: Jul. 26, 1994

[54] METHOD OF WET HONING A SUPPORT FOR AN ELECTROPHOTOGRAPHIC PHOTORECEPTOR

[75] Inventors: Yusuke Harada; Hidekazu Aonuma; Kazuyoshi Shimoyama; Yasuo Sakaguchi, Kanagawa, all of Japan

[73] Assignee: Fuji Xerox Co., Ltd., Tokyo, Japan

[21] Appl. No.: 120,399

[22] Filed: Sep. 14, 1993

Related U.S. Application Data

[62] Division of Ser. No. 409,688, Sep. 20, 1989, abandoned.

[30] Foreign Application Priority Data

Sep. 26, 1988 [JP] Japan ..... 63-238877

[51] Int. Cl.[5] ..... G03G 5/04

[52] U.S. Cl. ..... 430/127; 51/320; 430/69

[58] Field of Search ..... 430/127; 51/320

[56] References Cited

U.S. PATENT DOCUMENTS

| | | | |
|---|---|---|---|
| 4,701,392 | 10/1987 | Saitoh et al. | 430/127 |
| 4,739,591 | 4/1988 | Everhardus et al. | 51/319 |
| 4,851,091 | 7/1989 | Uesugi et al. | 51/319 |
| 5,166,023 | 11/1992 | Harada et al. | 430/62 |
| 5,238,467 | 8/1993 | Hashiba et al. | 51/309 X |

FOREIGN PATENT DOCUMENTS

| | | |
|---|---|---|
| 51-58954 | 5/1976 | Japan . |
| 58-17105 | 2/1983 | Japan . |
| 58-162975 | 9/1983 | Japan . |
| 59-158 | 1/1984 | Japan . |
| 59-128553 | 7/1984 | Japan . |
| 59-204048 | 11/1984 | Japan . |
| 60-79360 | 5/1985 | Japan . |
| 60-86550 | 5/1985 | Japan . |
| 60-112049 | 6/1985 | Japan . |
| 61-42663 | 3/1986 | Japan . |
| 62-186270 | 8/1987 | Japan . |

*Primary Examiner*—Roland Martin
*Attorney, Agent, or Firm*—Finnegan, Henderson, Farabow, Garrett & Dunner

[57] ABSTRACT

An electrophotographic photoreceptor is disclosed, including a substrate having thereon a photosensitive layer, wherein the substrate is subjected to a wet honing treatment with an abrasive agent which has a Knoop hardness of 1500 to 2900 kg/mm$^2$, a 50% particle size of 5 to 55 μm in terms of cumulative percentage, and a bulk specific gravity of 0.75 to 1.6 g/ml, at a spraying speed of 20 to 75 m/sec.

17 Claims, 1 Drawing Sheet

METHOD OF WET HONING A SUPPORT FOR AN ELECTROPHOTOGRAPHIC PHOTORECEPTOR

This is a division of application Ser. No. 07/409,688, filed Sep. 20, 1989, now abandoned.

FIELD OF THE INVENTION

The present invention relates to an electrophotographic photoreceptor having a photosensitive layer formed on a substrate prepared by roughening the surface of the substrate, and particularly to an electrophotographic photoreceptor suitable for an electrophotographic printer of a type line-scanning image a laser beam.

BACKGROUND OF THE INVENTION

Electrophotographic printers of a type using a laser beam line-scanning hitherto employ, as the laser beam, a gas laser of relatively short wavelength such as helium-cadmium laser, argon laser, helium-neon laser, etc., and as an electrophotographic photoreceptor therefor, CdS-binder type photosensitive layer and a charge transfer complex which are capable of forming a thick photosensitive layer (IBM Journal of the Research and Development, 1971, January, pp. 75–89). In such electrophotographic printers, no multiple reflection of the laser beam occurs within the photosensitive layer; and interference fringes have not been encountered practically at the image formation.

However, semiconductor lasers have come to be recently used in place of the gas lasers for the purpose of miniaturization and cost reduction of the apparatuses. Such semiconductor lasers generally have oscillation wavelengths in a long wavelength region of 750 nm or longer, creating needs for an electrophotographic photoreceptor having high sensitivity in long wavelength regions; and electrophotographic photoreceptors for such purpose have been developed.

As photoreceptors sensitive to long-wavelength light (e.g., 600 nm or longer), among the typical known types are lamination type electrophotographic photoreceptors having a photosensitive layer containing a phthalocyanine pigment such as copper phthalocyanine, and aluminum chloride phthalocyanine. Specific variations include a photosensitive layer having a lamination structure comprising a charge generating layer and a charge transporting layer, and electrophotographic photoreceptors employing selenium-tellurium film.

Such a photoreceptor sensitive to long wavelength light has a disadvantage such that, when it is mounted on a laser-beam-scanning type electrophotographic printer and is exposed to a laser beam, an interference fringe pattern appears in the toner image formed thereby to cause unsatisfactory image formation. One reason for this is believed to be that the long-wavelength laser radiations are not completely absorbed in the photosensitive layer, and the transmitted light specularly reflects at the surface of the substrate, forming multiple-reflection paths of the laser beam within the photosensitive layer, and interference occurs between the incident light and the reflected light at the surface of the photosensitive layer.

For solving the above problem, methods for roughening the surface of the electroconductive substrate employed in electrophotographic photoreceptors by anodic oxidation or buffing are proposed as described in JP-A-58-162975, JP-A-60-79360, JP-A-60-112049, JP-A-61-42663 and JP-A-62-186270 (The term "JP-A" as used herein means an "unexamined published Japanese patent application"); and also methods for eliminating multiple reflection occurring within the photosensitive layer by providing a light absorption layer or a reflection prevention layer between the photosensitive layer and the substrate are proposed as described in JP-A-58-17105, JP-A-59-158 JP-A-59-204048, and JP-A-60-86550.

The above-described proposed methods, however, could not completely eliminate the interference fringe pattern appearing in forming images practically. In particular, in roughening the surface of an electroconductive substrate, uniform roughness of the surface cannot easily be obtained, and sometimes a portion of relatively coarse roughness is formed in a certain proportion. The coarse roughness portion may function as a portion for injecting carriers into a photosensitive layer, thereby causing undesirably a white spot in image formation (or a black spot in negative development). Thus, there are various measures for preventing solely the appearance of interference fringe pattern; but simultaneous prevention of the occurrence of interference fringe patterns and prevention of the occurrence of black spots or white spots on the images is extremely difficult. Thus, the above methods cannot solve the problems of long-wavelength photoreceptors. Moreover, in the method for roughening the surface of the electroconductive substrate, production of electroconductive substrates having uniformly toughened surface through one production lot is difficult, involving many problems to be solved. On the other hand, the methods for employing a light absorption layer also have the disadvantage that they are incapable of preventing sufficiently the interference fringes and will increase the production cost.

Other superficially relevant techniques are not solutions. JP-A-51-58954 describes surface toughening of an electroconductive substrate by honing. JP-A-59-128553 describes surface roughening with a specific surface treating material. These descriptions are directed to improvement of adhesion of the photosensitive layer to the substrate but are incapable of preventing the appearance of the aforementioned interference fringe pattern.

SUMMARY OF THE INVENTION

An object of the present invention is to provide a novel electrophotographic photoreceptor free from the disadvantages of the prior art mentioned above, and a method of production thereof.

Another object of the present invention is to provide an electrophotographic photoreceptor which is completely free from both an interference fringe pattern appearing in image formation and white spots at image formation or black spots in negative image development, and a method of production thereof.

A further object of the present invention is to provide a method for treating a substrate for an electrophotographic photoreceptor.

According to an aspect of the present invention, there is provided an electrophotographic photoreceptor comprising a substrate having thereon a photosensitive layer, wherein the substrate is subjected to a wet honing treatment with an abrasive agent which has a Knoop hardness of 1500 to 2900 kg/mm$^2$, a 50% particle size of 5 to 55 μm in terms of cumulative percentage, and a bulk specific gravity of 0.75 to 1.6 g/ml at a spraying speed of 20 to 75 m/sec.

According to another aspect of the present invention, there is provided a method for treating a substrate for an electrophotographic photoreceptor, comprising a wet honing treatment comprising the step of spraying an abrasive agent onto the substrate, wherein the abrasive agent has a Knoop hardness of 1500 to 2900 kg/mm$^2$, a 50% particle size of 5 to 55 μm in terms of cumulative percentage, and a bulk specific gravity of 0.75 to 1.6 g/ml, and is sprayed at a spraying speed of 20 to 75 m/sec.

According to a further object of the present invention, there is provided a method for producing an electrophotographic photoreceptor, comprising (1) preparing a substrate which is subjected to a wet honing treatment by spraying an abrasive agent to roughen the surface of the substrate and then (2) forming on the substrate a photosensitive layer by coating a coating solution for the photosensitive layer, wherein the substrate is subjected to the wet honing treatment by spraying the abrasive agent having a Knoop hardness of 1500 to 2900 kg/mm$^2$, a 50% particle size of 5 to 55 μm in terms of cumulative percentage, and a bulk specific gravity of 0.75–1.6 g/ml, at spraying speed of 20 to 75 m/sec.

DETAILED DESCRIPTION OF THE INVENTION

Figure 1:
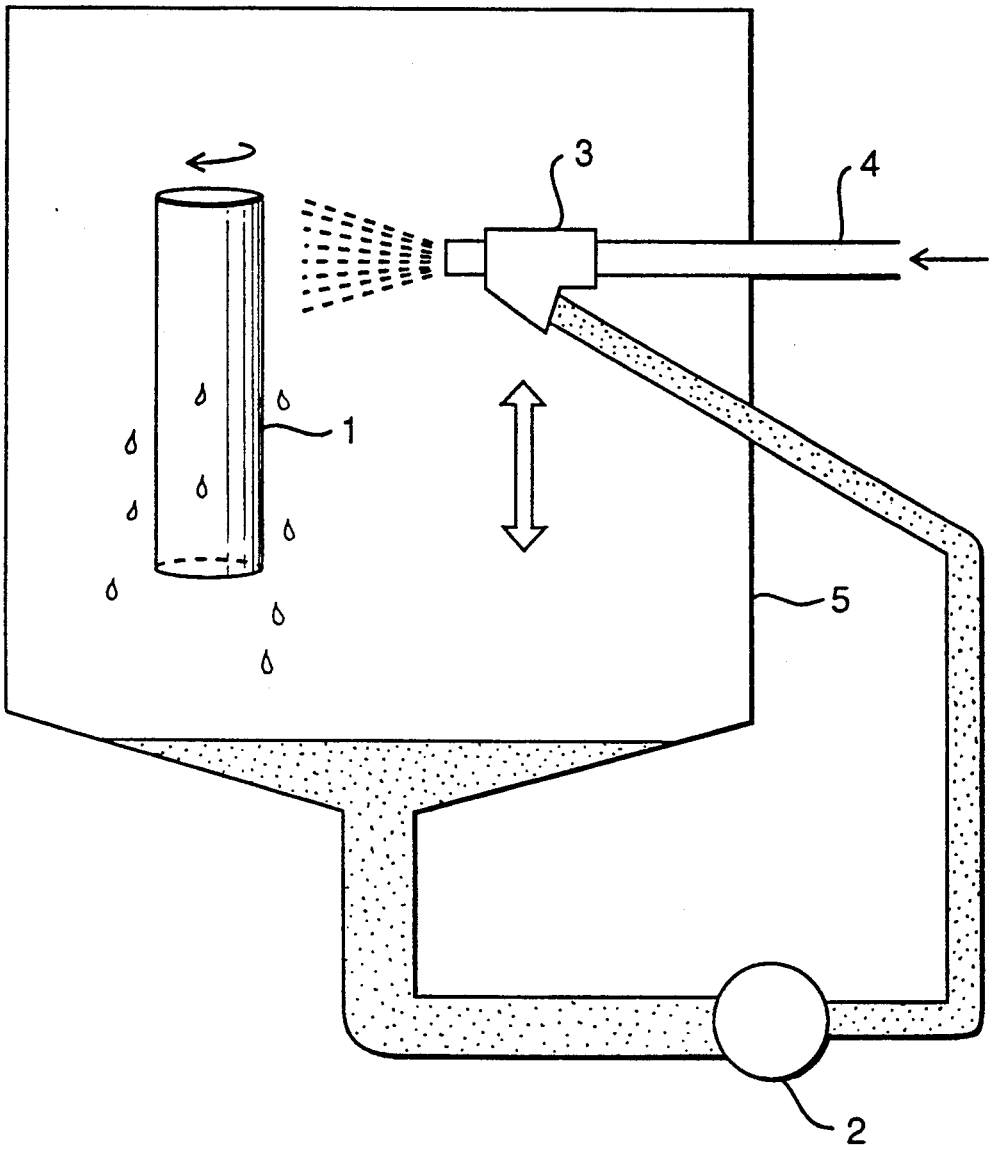
FIG. 1 illustrates schematically a wet honing apparatus employed in the present invention.

Since the interference of light is caused by specular reflection of laser light at the substrate surface, the elimination of the specular reflection can prevent the interference. For this purpose, what is first thought of is prevention of reflection by coating the surface of the substrate with a black paint. The obtained black coating film, however, could not completely prevent the interference because of the gloss of the black coating film surface which causes specular (regular) reflection of light. Accordingly, the present inventors have discovered effective diffuse (irregular) reflection to prevent the interference.

The present inventors, after extensive study, have found that, in general, roughening of a substrate surface to a degree necessary for eliminating the interference fringe pattern appearing at image formation will deleteriously increase the nun%her of white spots (or black spots in negative development), dependent on the degree of the surface roughness, giving inferior copies; but that using a substrate surface toughened by a specific abrasive material of the present invention will prevent the occurrence of the white spots or the black spots as well as the appearance of the interference fringe pattern, thus enabling improved long-wavelength electrophotographic photoreceptors.

In the electrophotographic photoreceptor of the present invention, the substrate employed may be a drum, sheet, or the like made of a metal such as aluminum, copper, iron, nickel or zinc or alloys of any of these. The surface of such a substrate is toughened according to the present invention. The toughening is practiced by a wet honing treatment. Generally, methods for roughening substrate surfaces includes adjustment of the accuracy of surface cut, pressure-contact of a grinding stone, anode oxidation, etching, sandpaper, wet honing, sandblasting, buffing, etc. Among these methods, the wet honing is preferred because of shortened treating time, simplicity of operation, ease of achieving the desired surface roughness, and stability. In the present invention, a uniformly satinized surface is formed by wet honing treatment spraying an abrasive agent having specific properties at a specific spraying speed.

The wet honing treatment is a method for roughening a surface of a substrate by spraying a suspension of a powdery abrasive agent onto a surface of a substrate at a high speed. In this treatment, the surface roughness is controlled by the spraying pressure, the spraying speed, the amount, kind, shape, dimension, hardness, specific gravity and suspension concentration of the abrasive material, etc. In the wet honing treatment of the present invention, the abrasive agent employed has a Knoop hardness of 1500 to 2900 kg/mm$^2$, a 50 % cumulative particle size of 5 to 55 μm, and a bulk specific gravity of 0.75–1.6 g/ml.

The abrasive agent is required to have a knoop hardness of 1500 to 2900 kg/mm$^2$. Further, the knoop hardness of the abrasive agent is preferably 1700 to 2600 kg/mm$^2$ and more preferably 1900 to 2300 kg/mm$^2$.

Knoop hardness of lower than 1500 kg/mm$^2$ of the abrasive agent will not give a sufficient satinized surface nor a desired image quality, while the hardness of higher than 2900 g of the abrasive agent will result in preferential grinding of any less-strong portions of the substrate surface, thus giving no uniform satinized surface, and resulting in image defects.

The abrasive agent is requried to have a 50% particle size of 5 of 55 μm in terms of cumulative percentage (measured according to JIS R6002). The particle size is preferably 10 to 45 μm and more preferably 20 to 40 μm. The particle size of smaller than 5 μm will not give sufficient satinized surface while the particle size of larger than 55 μm results in excessive grinding of the substrate surface, thus causing image defects.

Further, the abrasive agent is required to have a bulk specific gravity of 0.75 to 1.6 g/ml (measured according to JIS R61260). The bulk specific gravity of the abrasive agent is preferably 0.90 to 1.55 g/ml and more preferably 1.2 to 1.5 g/ml. The bulk specific gravity of lower than 0.75 g/ml results from a large ratio of the long axis to the short axis of the abrasive particles, and an excessively large ratio of needle shaped particles, leading to low mechanical strength of the abrasive agent, a lack of stability at an initial stage of the wet honing treatment, and an increase of the amount of attaching to or plunging into the substrate surface, thus causing image defects. A bulk specific gravity of higher than 1.6 g/ml will not give sufficiently satinized surface, and is likely to give a surface having a high glossiness, which is also undesirable.

Any material may be used for constituting the abrasive agent if it satisfies the aforementioned requirement. Among the materials, alumina containing materials are preferred. Preferable alumina containing materials are those predominantly constituted of $Al_2O_3$ and containing other metal oxides in an amount of not more than 30% by weight (particularly not more than 22% by weight) in total.

The use of excessive amount of metal oxides other than alumina affects adversely the wet honing treatment such that uniform roughness of the surface may not be obtained.

The alumina containing material in the present invention preferably contains $TiO_2$ to impart toughness. Although bauxite, the raw material, usually contains TiO2, the toughness of the alumina containing material can be controlled by positively adjusting the content of $TiO_2$.

The toughness generally depends upon the bonding strength within a crystalline material, which bonding strength is affected by a minor matrix component interposed in the crystalline boundary. In case of alumina also, its toughness depends upon formation of a solid solution of $TiO_2$ in the alumina crystal lattice. In the present invention, use of $TiO_2$ content of generally 1 to 5% by weight and preferably 2 to 3% by weight, is preferred for toughness of alumina.

$TiO_2$ dissolves in alumina in a state of a solid solution, and affects slip between space lattices to increase the toughness of alumina. When the $TiO_2$ content is less than 1% by weight, the roughness will be insufficient, and the desired satinized surface cannot be obtained at the early stage of wet honing, and also a steady satinized surface cannot be obtained, since the particle size will change after the honing treatment, namely after the abrasive agent is sprayed onto the substrate. On the other hand, when the $TiO_2$ content exceeds 5% by weight, the toughness of the abrasive agent will be too high to give a uniform satinized surface. Accordingly, the above-mentioned range of the present invention is preferable.

In cases where the $TiO_2$ content is less than 1% by weight, $Cr_2O_3$ may be advantageously added to compensate for the insufficiency of $TiO_2$. The addition of $Cr_2O_3$ in an amount of preferably 1 to 5% by weight (more preferably 1.5 to 3.8% by weight) can improve the toughness. When the contents of each $TiO_2$ and $Cr_2O_3$ are less than 1% by weight, the toughness of the abrasive material will be insufficient so that a sufficient satinized surface cannot be formed at an early stage of the wet honing treatment, and a steady satinized surface cannot be obtained since the particle size will change after the honing, namely, after the abrasive agent is sprayed onto the substrate.

As an abrasive agent, use of small balls or powdery fragments of cast steel, cast iron, or glass beads may be thought of. Cast iron or cast steel, when used in the honing treatment, tends to be retained on the substrate as an impurity, which functions undesirably as an injection site from the substrate to cause an image defect. Glass beads, when used in the treatment, give round craters on the treated surface since glass beads are in a shape close to a true sphere. Therefore, the treated surface has semigloss and smoothness: having higher glossness for the same surface roughness which tends to cause interference fringe pattern. Thus, glass beads are not suitable for the object of the present invention.

The above abrasive agent in the present invention needs to be sprayed onto the substrate surface at a spraying speed of 20 to 75 m/sec for roughening the surface. The preferable spraying speed is 25 to 60 m/sec. The spraying speed is determined by the distance from a substrate, compressed air pressure, nozzle opening diameter, etc., of a spray gun. The spraying speed of less than 20 m/sec will not give sufficient satinized surface, while the speed of higher than 75 m/sec will give minute unevenness on the satinized surface, forming no uniform satinized surface but forming white spots or black spots in the image.

On the above-described substrate, an undercoating layer may be provided, if desired, and a photosensitive layer is formed thereon.

The undercoating layer can be formed from a known resin. The thickness of the undercoating layer is preferably in the range of from 0.05 μm to 10 μm and particularly from 0.1 μm to 2 μm.

A photosensitive layer is formed on the undercoating layer. In the case where the photosensitive layer has a structure including lamination of a charge generating layer and a charge transporting layer, either layer may be provided on the under coating layer.

The charge generating layer comprises a charge generating material dispersed in a binder resin. A known charge generating material is employed therefor: the examples include azo dyes such as Chlorodian blue; quinone pigments such as anthanthrone and pyrene quinone; quinocyanine pigments; perylene pigments; perynone pigments; indigo pigments; bisbenzoimidazole pigments; phthalocyanine pigments such as copper phthalocyanin, metal-free phthalocyanine and vanadyl phthalocyanine; azulenium salts; squarylium pigments and quinacridone pigments.

The binder resin for the charge generating layer may be a known material such as polystyrene resins, polyvinylacetal resins, acryl resins, methacryl resins, vinyl acetate resins, polyester resins, polyacrylate resins, polycarbonate resins, and phenol resins.

The charge generating layer is formed by applying the binder resin solution containing a charge generating material onto the undercoating layer. The solvent for the dispersion is selected from ordinary organic solvents such as methanol, ethanol, n-propanol, n-butanol, benzyl alcohol, methylcellosolve, ethylcellosolve, acetone, methyl ethyl ketone, cyclohexanone, methyl acetate, dioxane, tetrahydrofuran, methylene chloride, and chloroform.

The thickness of the charge generating layer is generally in the range of from 0.1 to 5 μm and preferably from 0.2 to 2.0 μm.

The charge transporting layer comprises an electron transporting material dispersed in a binder resin. The examples of the charge transporting material include: polycyclic aromatic compounds such as anthracene, pyrene, and phenanthrene; nitrogen-containing heterocyclic compounds such as indole, carbazole, and imidazole; pyrazolines, hydrazones, triphenylmethanes, triphenylamines, enamines, and stilbenes. The binder resin may be of any film-forming resin: the examples include polyesters, polysulfones, polycarbonates such as bisphenol A type and bisphenol Z type polycarbonates, polymethylmethacrylates, etc.

The charge transporting layer is formed by applying a binder solution in a solvent containing the above-mentioned charge tranporting material so as to give a layer thickness of 5 to 30 μm. The solvent may be a usual organic solvent: for example, aromatic hydrocarbons such as benzene, toluene, and xylene; ketones such as acetone and 2-butanol; halogenated hydrocarbons such as methylene chloride, monochlorobenzene, and chloroform; and tetrahydrofuran and ethyl ether.

The examples below are intended to illustrate specifically the present invention.

EXAMPLES 1-9 and COMPARATIVE EXAMPLES 1-11

An aluminum pipe of 1 mm thick, 40 mm diameter, and 310 mm length was machined with a mirror-finishing lathe using a diamond cutting-tool to a surface roughness of Ra 0.04 μm (by Arithmetical mean deviation). This aluminum pipe was treated for roughening the surface with a liquid honing apparatus shown in FIG. 1, where the numeral 1 represents a substrate (the treated pipe), the numeral 2 represents a pump, the numeral 3 represents a gun, the numeral 4 represents an air introducing tube, and the numeral 5 represents a treating chamber. The liquid honing treatment was conducted as follows:

The abrasive agent shown in Table 1 in an amount of 10 kg was suspended in 40 liters of water. The suspension was sprayed from the gun 3 to the aluminum pipe at the spraying speed shown in Table 1 under a predetermined compressed air pressure while the suspension was being fed to the gun at a flow rate of 6 liters per minute by means of the pump 2. The gun was moved at a rate of 40 cm/min along the direction of the axis of the aluminum pipe. The aluminum pipe was rotated at 100 rpm.

TABLE 1

| | Knoop hardness ($kg/mm^2$) | 50% cumulative particle ($\mu m$) | Bulk specific gravity (g/ml) | Spraying rate (m/sec) | Materials (main component) | Metal oxide other than alumina (% by weight) | $TiO_2$ content (% by weight) |
|---|---|---|---|---|---|---|---|
| Example 1 | 2070 | 33 | 1.51 | 60 | Aluminum oxide (molten alumina) | 4–5 | 2.25 |
| Example 2 | 2070 | 10 | 0.94 | 70 | Aluminum oxide (molten alumina) | 4–5 | 2.25 |
| Example 3 | 2070 | 50 | 1.58 | 25 | Aluminum oxide (molten alumina) | 4–5 | 2.25 |
| Example 4 | 2200 | 24 | 1.55 | 25 | Aluminum oxide (molten alumina) | 14 | 2.05 |
| Example 5 | 1700 | 33 | 1.45 | 55 | Aluminum oxide (molten alumina) | 20 | 3.00 |
| Example 6 | 2500 | 40 | 1.52 | 35 | Aluminum oxide (molten alumina) | 22 | 1.13 |
| Example 7 | 2180 | 30 | 1.49 | 57 | Aluminum oxide (molten alumina) | 15 | — ($Cr_2O_3$ 2.5) |
| Example 8 | 1950 | 35 | 1.50 | 60 | Aluminum oxide Zirconium oxide | 50 | 1.1 |
| Example 9 | 2040 | 25 | 1.53 | 60 | Aluminum oxide (molten alunia) | 7 | 5.1 |
| Comparative Example 1 | 1300 | 33 | 1.51 | 70 | Aluminum oxide (molten alumina) | 7 | 2.25 |
| Comparative Example 2 | 3000 | 33 | 1.51 | 25 | Boron carbide | — | — |
| Comparative Example 3 | 2070 | 3.8 | 0.80 | 60 | Aluminum oxide (molten alumina) | 4–5 | 2.25 |
| Comparative Example 4 | 2070 | 60 | 1.58 | 60 | Aluminum oxide (molten alumina) | 4–5 | 2.25 |
| Comparative Example 5 | 2070 | 52.5 | 1.62 | 60 | Aluminum oxide (molten alumina) | 4–5 | 2.25 |
| Comparative Example 6 | 2070 | 6 | 0.70 | 60 | Aluminum oxide (molten alumina) | 4–5 | 2.25 |
| Comparative Example 7 | 2070 | 33 | 1.51 | 15 | Aluminum oxide (molten alumina) | 4–5 | 2.25 |
| Comparative Example 8 | 2070 | 33 | 1.51 | 80 | Aluminum oxide (molten alumina) | 4–5 | 2.25 |
| Comparative Example 9 | 1800 | 40 | 1.58 | 60 | Molten zircon | — | — |
| Comparative Example 10 | 1100 | 45 | 1.55 | 60 | Nitriding steel | — | — |
| Comparative Example 11 | — | 46 | — | 60 | Glass beads | — | — |

The abrasive agents used in the examples and the comparative examples are as below.

Example 1: Morandum A (A-40) made by Showa Denko K. K.

Example 2: Morandum A (A-43) made by Showa Denko K. K.

Example 3: Morandum A (A-40) made by Showa Denko K. K.

Example 4: Z Morandum (ZA-1) made by Showa Denko K. K.

Example 5: White alumina containing abrasive grain having a hardness adjusted by forming unstable crystalline alumina ($Na_2O.11Al_2O_3$), Knoop harness 1000) using $Na_2O$ contained in raw material alumina.

Example 6: Containing a high content of zirconia.

Example 7: An abrasive agent containing a high content of chromium oxide: Pink Morandum (PM) made by Showa Denko K. K.; RA made by Nippon Kenmazai K. K.; Rubygreen made by Degussa (West Germany); Electrohubin made by MSO (West Germany).

Example 8: An abrasive agent of alumina-zirconia type, containing 50% by weight of metal oxides other than alumina in total (Morandum A2 made by Showa Denko K. K.).

Example 9: An abrasive agent comprising molten alumina containing 5.1% of $TiO_2$.

Comparative example 1: White alumina type abrasive grain having a hardness adjusted by forming unstable crystalline $\beta$ alumina ($Na_2O.11Al_2O_3$, Knoop hardness 1000) using $Na_2O$ contained in raw material alumina.

Comparative example 2: Boron carbide.

Comparative example 3: Morandum A #3000 made by Showa Denko K. K.

Comparative example 4: An abrasive agent having the same composition as in Comparative example 3, except for average particle diameter of 60 $\mu m$.

Comparative example 5: Morandum A #240 made by Showa Denko K. K.

Comparative example 6: An abrasive agent having the same composition as in Comparative example 5, except for average particle diameter of 6 μm, and a bulk specific gravity of 0.70 g/ml.

Comparative examples 7 and 8: The same abrasive agent as in Example 1.

Comparative example 9: An abrasive agent mainly composed of molten zircon.

Comparative example 10: An abrasive agent mainly composed of nitriding steel.

Comparative example 11: Glass beads: Fuji Bright made by Fuji Seiki Seisakusho.

Onto the aluminum pipes having been subjected to wet honing treatment as stated above, a solution of a nylon copolymer resin (CM 8000, made by Toray Industries, Inc.) in methanol/butanol was applied by a ring coater to form an undercoating layer having 0.7 μm thick as a barrier layer.

Separately, 3 parts of vanadyl phthalocyanine was dispersed in 70 parts of a solution of 10% solution of polyester resin (PE 100, made by Goodyear Chemical) in cyclohexane by means of a ball mill with a 10 mm-diameter ball for 2 hours. 10 parts of 2-butanone was added thereto to prepare a coating solution. This coating solution was applied onto the barrier layer by a ring coater to form 0.4 μm thick charge generating layer.

A charge transporting layer was formed on the thus formed charge generating layer as below. 4 parts of N, N'-diphenyl-N,N'-bis(3-methylphenyl)-[1,1-biphenyl]-4,4'-diamine as the charge transporting material together with 6 parts of polycarbonate Z resin were dissolved in 40 parts of monochlorobenzene. The resulting solution was applied on the charge generating layer with a dipcoater at a draw-up rate of 11 cm/min., and was dried at 110° C. for 1 hour to form a 20 μm thick charge transporting layer, thus providing an electrophotographic photoreceptor (including substrate).

The obtained electrophotographic photoreceptor was mounted on a laser printer (LBP) capable of printing at a dot density of 400 dpi, and the output images were examined. In Examples 1 to 7, no image defect such as interference fringe pattern and white spots or black spots was observed. Moreover, no abnormality was observed in 200 sheets of image output test. In Examples 8 and 9, only slight black specks were found but no interference fringe pattern was observed.

On the contrary, in the Comparative examples, the following results were obtained. In Comparative example 1, sufficient satinized surface could not be obtained, and interference fringe pattern was observed in the image. Even with a higher spraying speed to compensate the low hardness of the abrasive agent, sufficient satinized surface could not be obtained at the early stage of the wet honing treatment. Moreover, after successive wet honing treatment of 1000 pipes, the observation of the abrasive agent with an optical microscope revealed that the diameter of the particles thereof was reduced by approximately 25%, thus, the life of the abrasive agent was remarkably shortened.

In Comparative example 2, less strong portions of the substrate surface were preferentially abraded, so that a uniform satinized surface could not be obtained, and many black spots were found in the white ground.

In Comparative example 3, an interference fringe pattern was found in the image.

In Comparative example 4, various image defects were found such as black spots and blotch although no interference fringe pattern was found in the image.

In Comparative example 5, no uniform satinized surface was obtained and image defects were observed.

In Comparative examples 6 and 7, interference fringe patterns were observed in the images.

In Comparative example 8, many black spots were observed, but no interference fringe pattern was observed.

In Comparative examples 9 and 10, many image defects (black spots , white spots , and blotch) were observed, but no interference fringe pattern was observed.

In Comparative example 11, sufficient satinized surface could not be obtained, and an interference fringe pattern was observed.

In the present invention, as the result of the roughening of a substrate surface by the wet honing treatment as stated above, a satinized surface is formed on the substrate surface, with a surface state of sufficiently high average surface roughness and a narrow surface roughness distribution. Accordingly, an electrophotographic photoreceptor employing the substrate forms satisfactory images without any image defect such as an interference fringe pattern, white spots, or black spots, when an image is formed by relative long-wavelength laser light, such as obtained from a semiconductor laser. Therefore, the electrophotographic photoreceptor of the present invention is suitable for electrophotographic copying machines, particularly for those of the type imagewise line-scanning laser beam.

While the invention has been described in detail and with reference to specific embodiments thereof, it will be apparent to one skilled in the art that various changes and modifications can be made therein wihtout departing from the spirit and scope thereof.

What is claimed is:

1. A process for making an electrophotographic photoreceptor for producing a line-scanning image comprising:

providing a substrate composed of a metal or a metal alloy;

uniformly roughening the substrate by a wet honing process using an abrasive agent composed of an alumina-containing material, said uniformly roughened surface being formed with an effective diffuse reflection and a minimal glossiness effective to eliminate an interference fringe pattern from the line-scanning image without forming spots; and disposing a photosensitive layer on the uniformly roughened surface.

2. The process for making an electrophotographic photoreceptor as claimed in claim 1, wherein the alumina-containing material in the wet honing process contains $Al_2O_3$ as a main component, and other metal oxides in an amount of not more than 30% by weight in total.

3. The process for making an electrophotographic photoreceptor as claimed in claim 2, wherein the alumina-containing material in the wet honing process contains $TiO_2$ in an amount of from 1 to 5% by weight.

4. The process for making an electrophotographic photoreceptor as claimed in claim 2, wherein the alumina-containing material in the wet honing process contains $TiO_2$ in an amount of not more than 1% by weight, and $Cr_2O_3$ in an amount of from 1 to 5by weight.

5. The process for making an electrophotographic photoreceptor as claimed in claim 1, further comprising the step of disposing an undercoating layer between the uniformly roughened surface and the photosensitive layer, said undercoating layer being formed of a resin having a thickness in a range of approximately 0.05 to 10 μm.

6. The process for making an electrophotographic photoreceptor as claimed in claim 1, further comprising the step of disposing an undercoating layer between the uniformly roughened surface and the photosensitive layer, said undercoating layer being formed of a resin having a thickness in a range of approximately 0.1 to 2.0 μm.

7. The process for making an electrophotographic photoreceptor as claimed in claim 5, wherein said undercoating layer is formed from a solution of a nylon copolymer resin in methanol/butanol.

8. The process for making an electrophotographic photoreceptor as claimed in claim 6, wherein said undercoating layer is formed from a solution of a nylon copolymer resin in methanol/butanol.

9. The process for making an electrophotographic photoreceptor as claimed in claim 1, wherein said photosensitive layer comprises a charge generating layer having a thickness in a range of approximately 0.1 to 5.0 μm.

10. The process for making an electrophotographic photoreceptor as claimed in claim 1, wherein said photosensitive layer comprises a charge generating layer having a thickness in a range of approximately 0.2 to 2.0 μm.

11. The process for making an electrophotographic photoreceptor as claimed in claim 1, wherein said photosensitive layer comprises a charge transporting layer having a thickness in a range of approximately 5 to 30 μm.

12. The process for making an electrophotographic photoreceptor as claimed in claim 1, wherein said uniformly roughened surface is a wet honed, uniformly satinized surface.

13. The process for making an electrophotographic photoreceptor as claimed in claim 1, wherein said abrasive agent used in the wet honing process has a Knoop hardness range of approximately 1500 to 2900 kg/mm$^2$, a 50% particle size range of approximately 5 to 55 μm in terms of cumulative percentage, and a bulk specific gravity in a range of approximately 0.75 to 1.6 g/m.

14. The process for making an electrophotographic photoreceptor as claimed in claim 1, wherein said abrasive agent used in the wet honing process has a Knoop hardness range of approximately 1700 to 2600 kg/mm$^2$, a 50% particle size range of approximately 10 to 45 μm in terms of cumulative percentage, and a bulk specific gravity in a range of approximately 0.90 to 1.55 g/m.

15. The process for making an electrophotographic photoreceptor as claimed in claim 1, wherein said abrasive agent used in the wet honing process has a Knoop hardness range of approximately 1900 to 2300 kg/mm$^2$, a 505 particle size range of approximately 20 to 40 μm in terms of cumulative percentage, and a bulk specific gravity in a range of approximately 1.2 to 1.5 g/m.

16. The process for making an electrophotographic photoreceptor as claimed in claim 1, wherein said wet honing includes spraying the abrasive agent at a speed in a range of approximately 20 to 75 m/sec.

17. The process for making an electrophotographic photoreceptor as claimed in claim 1, wherein said wet honing includes spraying the abrasive agent at a speed in a range of approximately 25 to 60 m/sec.

* * * * *

UNITED STATES PATENT AND TRADEMARK OFFICE

CERTIFICATE OF CORRECTION

PATENT NO. : 5,332,643

DATED : July 26, 1994

INVENTOR(S) : Yusuke HARADA et al

It is certified that error appears in the above-indentified patent and that said Letters Patent is hereby corrected as shown below:

Claim 4, Column 10, Line 61 change "5by" to --5% by--.

Claim 15, Column 12, Line 21 change "505" to --50%--.

Signed and Sealed this

Twenty-eight Day of March, 199

Bruce Lehman

*Attest:*

BRUCE LEHMAN

*Attesting Officer*

*Commissioner of Patents and Trademarks*